US006345901B1

(12) United States Patent
Pan

(10) Patent No.: US 6,345,901 B1
(45) Date of Patent: Feb. 12, 2002

(54) MINIATURE LIGHT BULB SOCKET WITH ENGAGING MECHANISM

(76) Inventor: Wun Fang Pan, No. 123, Lane 99, Pu Din Road, Hsinchu (TW)

( * ) Notice: Subject to any disclaimer, the term of this patent is extended or adjusted under 35 U.S.C. 154(b) by 0 days.

(21) Appl. No.: 09/504,837

(22) Filed: Feb. 16, 2000

(51) Int. Cl.[7] ..... H01R 33/09

(52) U.S. Cl. ..... 362/226; 362/238; 362/249; 362/806

(58) Field of Search ..... 362/249, 353, 362/443, 252, 238, 806, 226; 439/611, 616, 476.1, 483, 577

(56) References Cited

U.S. PATENT DOCUMENTS 5,001,615 A * 3/1991 Stefanelli ..... 362/226
5,428,516 A * 6/1995 Harris ..... 362/226
5,580,159 A * 12/1996 Liu ..... 362/226
5,643,011 A * 7/1997 Tsai ..... 439/619
5,701,051 A * 12/1997 Lin ..... 313/318.1
6,048,074 A * 4/2000 Wang ..... 362/226

* cited by examiner

*Primary Examiner*—Sandra O'Shea
*Assistant Examiner*—Ismael Negron
(74) *Attorney, Agent, or Firm*—Rosenberg, Klein & Lee

(57) ABSTRACT

An engaging mechanism used in miniature light bulb sockets is provided that comprises a pair of outwardly projecting claws disposed on one side of a bulb holder and a raised block formed on the side wall of a light bulb socket body on a corresponding position. These two claws define a slot therebetween. Each claw has a stepped face on its inner surface. The raised block is configured to have an outwardly extending outer end that has a larger thickness with a round top. When the light bulb holder is mounted on the top of the socket body, the raised block extends into the slot between two claws and can be securely held therein.

3 Claims, 4 Drawing Sheets

MINIATURE LIGHT BULB SOCKET WITH ENGAGING MECHANISM

BACKGROUND OF THE INVENTION

A Christmas light bulb set typically comprises a miniature light bulb seated in a bulb holder and enclosed in a socket body. The bulb holder and socket body are made of plastic materials and usually interconnected by press fit. The outer diameter of the bulb holder is slightly larger than the inner diameter of the socket body in order to attain a tight fit. However it brings difficulties in manufacturing. If the holder is too large, it is hard to insert the holder into a socket body. On the other hand, if the holder is smaller than the required, the holder will easily slip out of a socket body. Thus such a securing mechanism causes much trouble in the field.

In view of the above problem, the primary object of the invention is to provide an engaging mechanism that is used in a miniature light bulb socket and by which a light bulb holder can be securely combined with a socket body without a separation possibility. Now the features and advantages of the present invention will be detailed below with reference to the accompanying drawings.

BRIEF DESCRIPTION OF ACCOMPANYING DRAWINGS

DETAILED DESCRIPTION OF PREFERRED EMBODIMENTS

Figure 1:
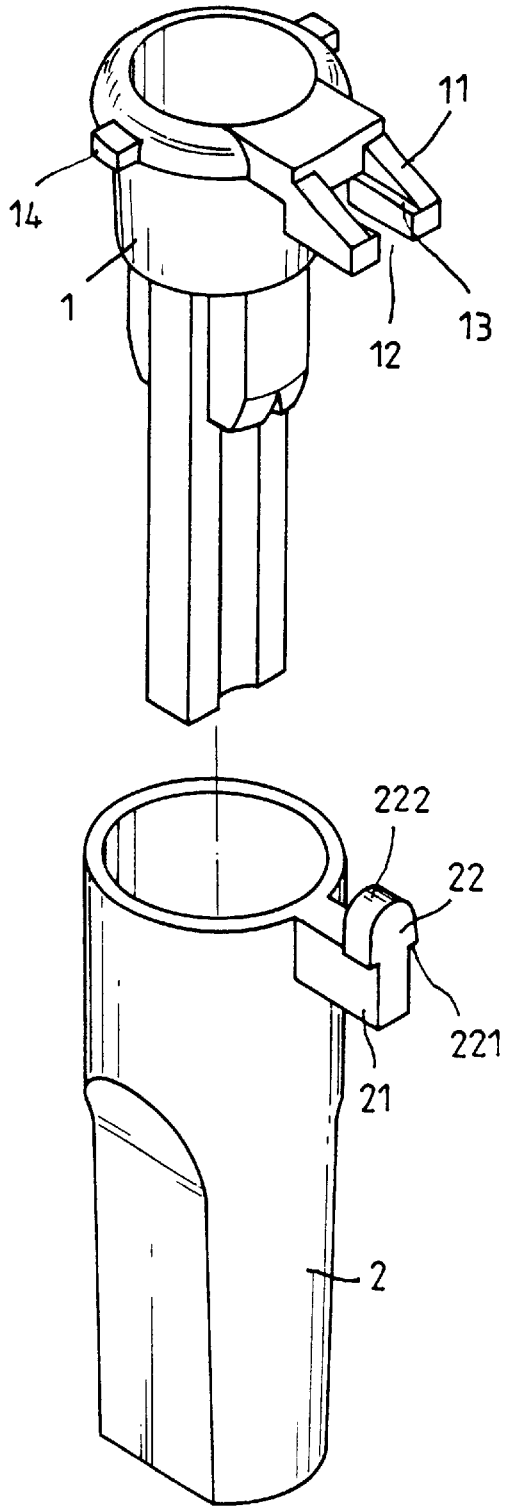
FIG. 1 is an exploded perspective view showing a miniature light bulb socket using the engaging mechanism of the invention.

Referring to the accompanying drawings, the invention mainly aims at the improvement of a Christmas light bulb set. It comprises a light bulb holder (1) that accommodates a miniature light bulb (3) therein and are housed in a socket body (2) to form a light bulb set. The light bulb socket according to the invention is featured by a pair of outwardly extending claws (11) formed on one side of the light bulb holder (1). Two claws (11), each having a stepped inner wall (13), define a slot (12) therebetween. In addition, the socket body (2) is provided on one side wall with a raised block (21), which is configured to have an outwardly extending outer end (22). The outer end (22) has a larger thickness and is provided with undercut shoulders (221) on two sides and a round top (222).

Figure 2:
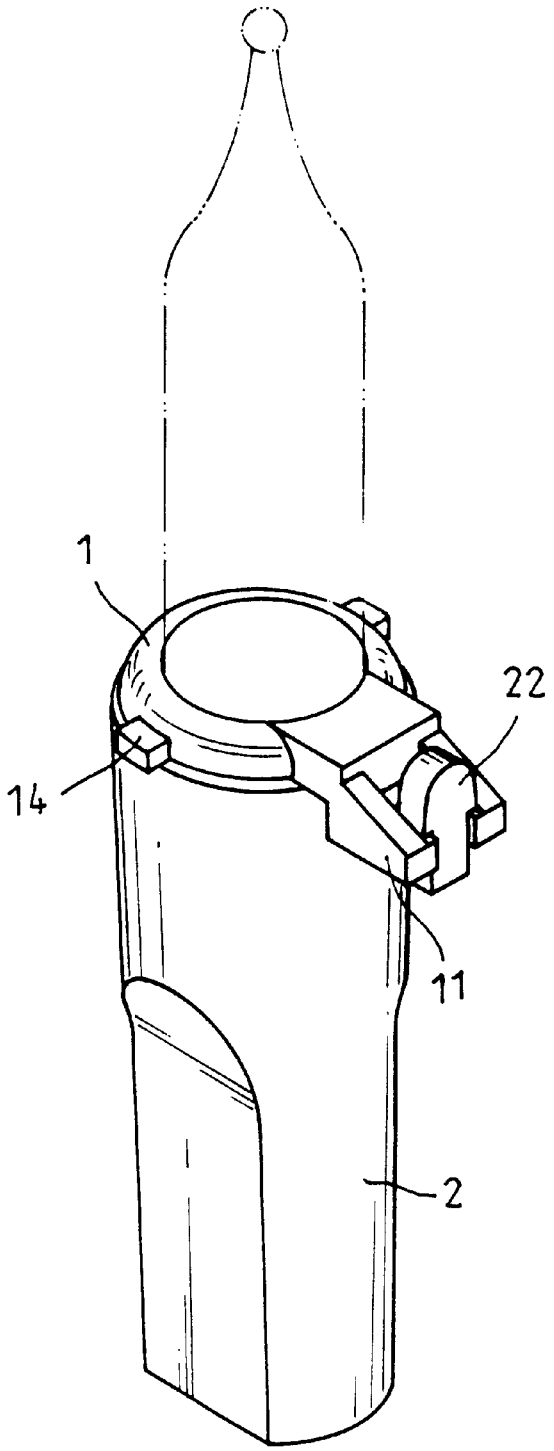
FIG. 2 is a perspective view showing the light bulb socket of FIG. 1 in an assembled state.
Figure 3:
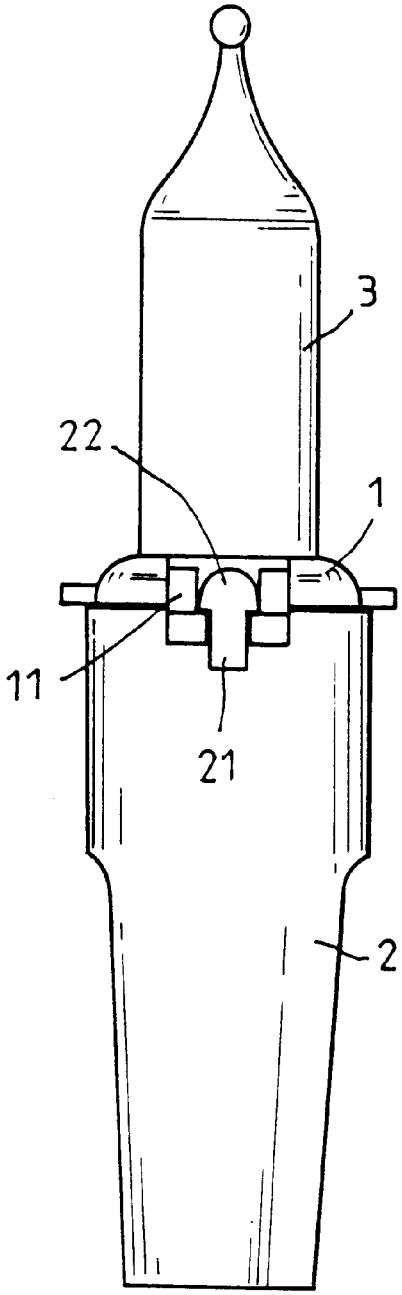
FIG. 3 is a plan view indicating the assembled light bulb socket of FIG. 1.
Figure 4:
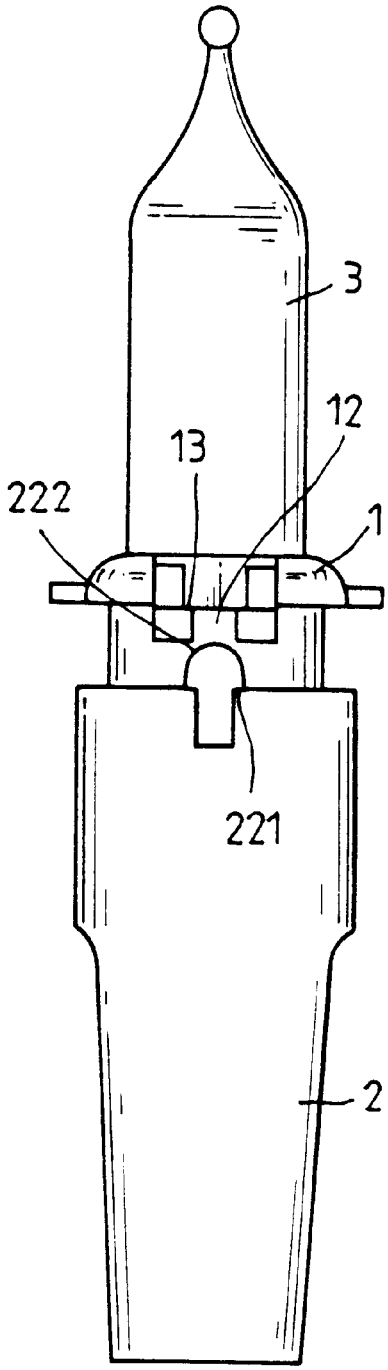
FIG. 4 illustrates the state of the light bulb socket immediately before engaging the holder with the socket body.
Figure 5:
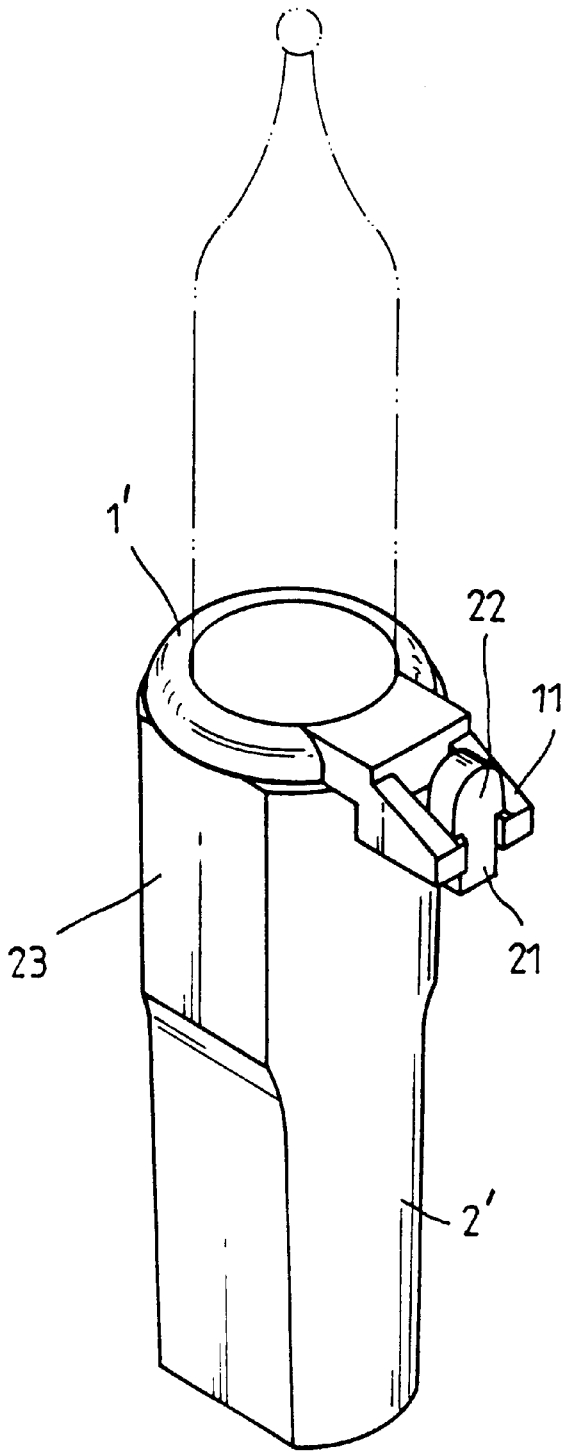
FIG. 5 shows another preferred embodiment of the invention.

When the light bulb holder (1) is mounted on the socket body (2), the round top (222) of outer end (22) of the raised block (21) will extend into the slot (12) between two claws (11). Because that the claws (11) are made of plastic materials, they have some resilience. The space between two claws (11) will be enlarged when the round top (222) of the outer end (22) gets into it. After the round top (222) completely passes through the slot (12), two claws (11) restore to their original position and the undercut shoulders (221) rest on the stepped wall (13) of the claws (11) as shown in FIGS. 2 and 3. Such a mechanism forms an effective interconnection. Therefore, after assembled, the holder and the socket body can achieve a secure engagement without an inadvertent separation possibility.

present invention is further featured by a stud (14) formed on two sides of the light bulb holder (1). When a light bulb does not work and must be replaced, the two studs (14) provide points at which external forces can be applied to pull the holder (1) out of the socket body (2). Many variations of such an aid tool for exerting forces can be made according to the invention. As can be seen from FIG. 5, using two flat portions (23) formed on two sides of the socket body (2') in place of studs (14) can facilitate separation of the bulb holder (1') from the socket body (2').

From the above description, evidently the invention has originality and practical applicability. We hereby apply for a patent grant.

What is claimed is:

1. A miniature light bulb socket with an engaging mechanism comprising:

a light bulb holder adapted to receive a miniature light bulb therein, said light bulb holder having an annular flange on one end thereof and a pair of claws extending outwardly from said flange, said claws having a slotted opening formed therebetween, each of said claws having a stepped inner wall surface; and a longitudinally extended socket body having an open end for receiving said light bulb holder therein, said socket body having a raised block formed on a side wall thereof adjacent said open end and in aligned relationship with said slotted opening, said raised block having an outer end extending longitudinally therefrom, said outer end having (a) a width dimension greater than a width dimension of said slotted opening, (b) a rounded top portion, and (c) a pair of undercut shoulders respectively formed on two sides of said outer end, wherein responsive to insertion of said light bulb holder into said open end of said socket body said rounded top portion of said outer end of said raised block passes into said slotted opening to laterally deflect said pair of claws until said stepped inner wall surface of each of said claws engages a respective undercut shoulder of said outer end to releasably secure said light bulb holder to said socket body.

2. A miniature light bulb socket with an engaging mechanism comprising:

a light bulb holder adapted to receive a miniature light bulb therein, said light bulb holder having an annular flange on one end thereof and a pair of claws extending outwardly from said flange, said claws having a slotted opening formed therebetween, each of said claws having a stepped inner wall surface, said light bulb holder having a pair of studs respectively extending laterally from two sides of said flange; and a longitudinally extended socket body having an open end for receiving said light bulb holder therein, said socket body having a raised block formed on a side wall thereof adjacent said open end and in aligned relationship with said slotted opening, said raised block having an outer end extending longitudinally therefrom, said outer end having (a) a width dimension greater than a width dimension of said slotted opening, (b) a rounded top portion, and (c) a pair of undercut shoulders respectively formed on two sides of said outer end, wherein responsive to insertion of said light bulb holder into said open end of said socket body said rounded top portion of said outer end of said raised block passes into said slotted opening to laterally deflect said pair of claws until said stepped inner wall surface of each of said claws engages a respective undercut shoulder of said outer end to releasably secure said light bulb holder to said socket body, said light bulb holder being separable from said socket body by application of an external force to said studs relative to said socket body.

3. A miniature light bulb socket with an engaging mechanism comprising:

a light bulb holder adapted to receive a miniature light bulb therein, said light bulb holder having an annular flange on one end thereof and a pair of claws extending outwardly from said flange, said claws having a slotted opening formed therebetween, each of said claws having a stepped inner wall surface; and a longitudinally extended socket body having an open end for receiving said light bulb holder therein, said socket body having a raised block formed on a side wall thereof adjacent said open end and in aligned relationship with said slotted opening, said raised block having an outer end extending longitudinally therefrom, said outer end having (a) a width dimension greater than a width dimension of said slotted opening, (b) a rounded top portion, and (c) a pair of undercut shoulders respectively formed on two sides of said outer end, wherein responsive to insertion of said light bulb holder into said open end of said socket body said rounded top portion of said outer end of said raised block passes into said slotted opening to laterally deflect said pair of claws until said stepped inner wall surface of each of said claws engages a respective undercut shoulder of said outer end to releasably secure said light bulb holder to said socket body, said socket body having a flat portion formed on two sides thereof adjacent said open end, said flange of light bulb holder having a perimeter edge extending beyond said flat portions of said socket body, wherein said light bulb holder is separable from said socket body by application of an external force relative to said socket body to said perimeter edge of said flange adjacent said flat portion of said socket body.

* * * * *